United States Patent [19]

Premel

[11] Patent Number: 4,463,686

[45] Date of Patent: Aug. 7, 1984

[54] APPARATUS FOR REMOVAL OF ASH AND SLAG

[75] Inventor: Ulrich Premel, Gummersbach, Fed. Rep. of Germany

[73] Assignee: L. & C. Steinmüller GmbH, Gummersbach, Fed. Rep. of Germany

[21] Appl. No.: 539,328

[22] Filed: Oct. 5, 1983

[30] Foreign Application Priority Data

Oct. 5, 1982 [DE] Fed. Rep. of Germany ..... 3236753

[51] Int. Cl.[3] ..... F23J 1/00

[52] U.S. Cl. ..... 110/165 R; 48/77; 110/171; 110/229

[58] Field of Search ..... 110/165 R, 171, 259, 110/229; 48/77

[56] References Cited

U.S. PATENT DOCUMENTS

| | | | |
|---|---|---|---|
| 1,988,473 | 1/1935 | Bennett | 110/165 R |
| 2,693,775 | 11/1954 | Berry | 110/165 R |
| 4,073,244 | 2/1978 | Snowden | 110/165 R |
| 4,126,427 | 11/1978 | Eales | 110/165 R X |
| 4,312,637 | 1/1982 | Loftus | 110/165 R X |
| 4,321,877 | 3/1982 | Schmidt et al. | 110/165 R |

*Primary Examiner*—Edward G. Favors

*Attorney, Agent, or Firm*—Becker & Becker, Inc

[57] ABSTRACT

An apparatus for dry removal of hot residues resulting from a gasification of coal or carbon-containing solid materials in the lower region or a shaft-like fluid flow gasification reactor which is operated under pressure in downward flow. A wall-heating surface, having upward flow therethrough and having a tube-fin-tube construction, is disposed parallel to and on the inner side of the insulation of the pressure tank wall. This wall-heating surface tapers in the manner of a funnel from a large cylindrical diameter to a small cylindrical diameter. The wall-heating surface has a constricted throat, and thereafter passes over from the cylindrical cross section to the cross section of a four-cornered chamber. Inlet openings are located directly ahead of and at the narrowest point of the constricted throat for cold, clean product gas which is used as fluidizing and cooling gas. A size-reducing and conveying device in the form of two cooled crushing rings which operate in opposite directions is disposed after the constricted throat. Convection heating surfaces provided with small tube intervals are tied into the cooling medium circulation for the wall-heating surface. A shutoff or charging system is disposed directly below the entry region or the cooled wall-heating surface.

1 Claim, 1 Drawing Figure

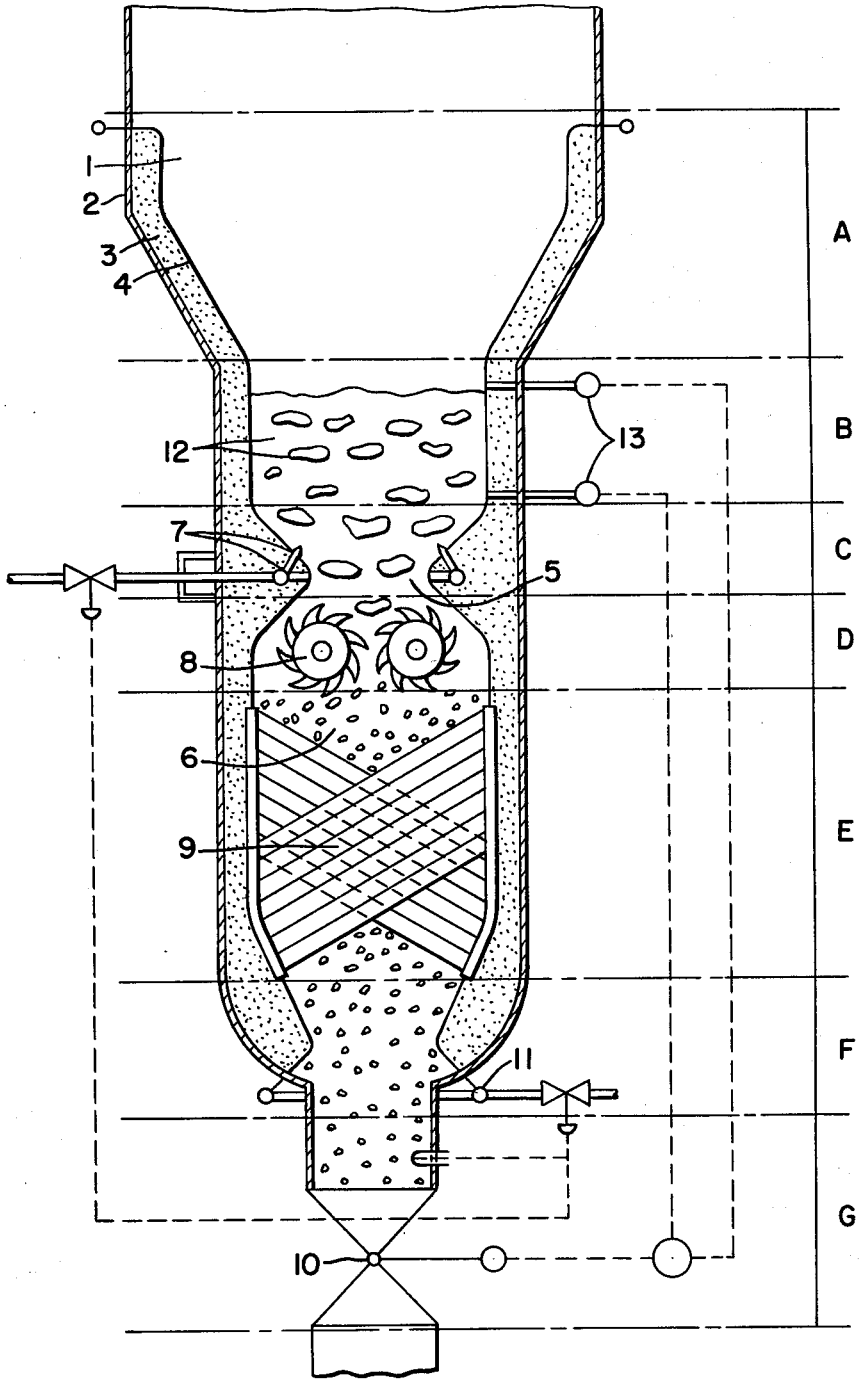
1
2
3
4
A
B
12
13
7
C
5
D
8
6
E
9
F
11
G
10

APPARATUS FOR REMOVAL OF ASH AND SLAG

BACKGROUND OF THE INVENTION

The present invention relates to an apparatus for dry removal of hot residues resulting from a gasification of coal or carbon-containing solid material in the lower region of a shaft-like fluid flow gasification reactor which is operated under pressure and in downward flow. The apparatus comprises a pressure tank wall which is lined on the inside with insulating material, such as brick, one or more cooling devices, a sizereducing and conveying device, and a pressure charging system. With a number of fluid flow gasification processes, the gasification residues are withdrawn in fluid form at the bottom of the reactor by means of a slag bed. In this connection, one must make allowances for the difficulties connected with the chemical or even mechanical attack of the fluid slag on the masonry. For this purpose, many tests are necessary until the most advantageous type of construction is found in each individual case.

Another possibility is to treat the gasification residues, which can be either solid or liquid, in the reactor in such a way that they can be removed in the solid state in either wet or dry form. The treatment of residues is generally effected in such a way that the ashes only melt in the hottest zone of the reactor, only agglormerate slightly due to the insulating effect of the non-gasified carbon or by means of a steam veil- and not only for protection of the masonry, and again solidifies in a region of the reactor which is not so hot.

It is not always possible to remove the solid gasification residues in wet form. Thus, apparatus where the reactor wall extends into a water seal, out of which the ashes or the granulated slag is cooled and continuously mechanically removed, have the drawback that the operation under pressure necessitates great overall height of the apparatus. Furthermore, problems arise if, due to appropriate process conditions, slag floats on the water bath, or if the wet withdrawal is blocked in the narrowest discharge opening due to large pieces of slag.

It is also known to remove the gasification residues from the reactor in the dry state. For this purpose, various types of structures are used to collect the residues, which are subsequently conveyed by means of a skimmer, for example in the form of an agitator, into a tightly closed ash box or to a discharge opening which is equipped with a charging system; the material is periodically removed from these places. The attempt has also been made to utilize rust proof apparatus.

Unfortunately, all heretofore known apparatus for the dry removal of solid gasification residues have the drawback that the uncooled residues obtained in the gasification reactor, which is operated under pressure, cannot, due to their varying material and thermal states, their particle sizes, and their behavior, assure an economically feasible and trouble-free continuous operation.

It is an object of the present invention to develop an apparatus of the aforementioned general type for dry removal of hot gasification residues which makes it possible to remove gasification residues, which can vary from the solid to the liquid state and from large pieces to powder, in such a way that they are cooled and create no problem with regard to transport.

BRIEF DESCRIPTION OF THE DRAWING

This object, and other objects and advantages of the present invention, will appear more clearly from the following specification in conjunction with the accompanying drawing, which schematically illustrates one preferred specific embodiment of the present invention.

SUMMARY OF THE INVENTION

The apparatus of the present invention is characterized primarily in that, when viewed in the axial direction, it comprises seven zones, namely A–G, having the following combination of features:

(a) A wall-heating surface which extends from Zone A to F, and is disposed parallel to and on the inner side of the insulation of the container wall. A cooling medium flows through the wall-heating surface in counter and upwards flow. The wall-heating surface has a concentric tube-fin-tube construction, and tapers, in Zone A, in a funnel-like manner from a large cylindrical diameter to a small cylindrical diameter. In Zone C the wall-heating surface has a constricted throat, and in Zone D it passes over from the cylindrical cross section having the small cylindrical diameter which exists prior to the constricted throat into the cross section of a four-cornered chamber; it maintains this cross sectional shape until Zone F;

(b) inlet openings are located in Zone C directly ahead of and at the narrowest point of the constricted throat for cold, clean product gas which is used as fluidizing and cooling gas;

(c) a size-reducing and conveying device in the form of two cooled crushing rings or rollers which work in opposite directions is disposed in Zone D directly behind the narrowest point of the constricted throat;

(d) convection heating surfaces in Zone E are provided with small tube intervals and are tied into the cooling medium circulation for the wall-heating surface; and (e) a shutoff or charging system is disposed in Zone G directly below the entry region of the cooled wall-heating surface.

DESCRIPTION OF A PREFERRED EMBODIMENT

A fluid flow gasification reactor 1, which is operated under pressure and in downward flow, is provided within the pressure tank body 2 with a lining of insulating material 3. The inventive apparatus for dry removal of hot gasification residues is located in the lower region of the reactor 1. Viewed in the axial direction, this apparatus is divided into seven zones. A wall-heating surface 4 which extends from Zone A to Zone F is supported on the inner side of the lining of the apparatus. The heating surface 4 has a concentric tubecross-piece-tube construction, and inventively has a cooling medium flowing therethrough in counter current and upward flow. In Zone A, the heating surface 4 tapers in the manner of a funnel from a large cylindrical diameter to a small cylindrical diameter. In Zone C, the heating surface 4 has a constricted throat 5. In Zone D, the heating surface 4 passes over from the cylindrical cross section having the same small cylindrical diameter which exists prior to the constricted throat, into the cross section of a four-cornered chamber 6; it maintains this cross-sectional shape until Zone F. In Zone C, directly ahead of and at the narrowest point of the constricted throat, there are located inlet openings 7 for the cold, clean product gas which is used as fluidizing and cooling gas. Directly after the narrowest point of the constricted throat, in Zone D, there is disposed a size-reducing and conveying device 8 in the form of two cooled rollers which work in opposite directions. In Zone E, the inventive apparatus further includes convection heating surfaces 9 which have small tube intervals and are tied in with the cooling medium circulation for the wall-heating surface. In Zone G, directly below the inlet region 11 of the cooled wall-heating surface, the inventive apparatus is also provided with a shut off or charging system 10.

The inventive apparatus has to accomplish the following tasks: Solid gasification residues of various sizes, and having a temperature of about 900° C., strike the funnel-shaped wall-heating surface 4, in Zone A, where they are reduced in size upon impact and are cooled off, and subsequently drop into the cylindrical shaft of the Zone B to build up a column 12 of ash and slag. This static column 12 is cooled very quickly, and, with certain variations in height, stands protectively over the inlet openings 7 and the cooled rollers of the size-reducing and conveying device 8 in order to trap large fluid slag particles which might drop out of the reactor, or to trap large pieces of dirt which might have been loosened from a radiation cooler by heating surface cleaning devices. Moreover, from a temperature standpoint, the aforementioned column protects the size-reducing rollers 8 located therebelow from fluid ash or slag particles, or ash or slag particles which have become too hot. So that this column does not solidify and prevent the removal process, clean product gas is blown into the column 12 above the inlet openings 7, thereby achieving a certain loosening or aerating, and a cooling of the slag particles. To move the column forward, the two water-cooled rollers 8 are provided in Zone D. At the same time, these rollers 8 reduce the size of large gasification residues so that they can pass without hindrance the convection heating surfaces 9 located in Zone E for a further cooling before the residues, at approximately 250° C., leave the pressure reactor via the charging system 10 located therebelow in Zone G.

The charging system 10, or the shut off device, is actuated based on the ash level in the Zone B; this ash level is regulated via gamma pilots 13. In order to maintain the efficiency and effectiveness of the convection heating surfaces 9, the latter are equipped with nonillustrated pneumatic beaters, as a result of which no dirt or contamination rings of ash form about the cooling/heating surfaces, which would reduce the cooling effect. The cooling system is regulated by the exit temperature of the slag. The same is true for the addition of cool product gas.

The system offers the advantage of a dry withdrawal of gasification residues using a gasification reactor which is operated under pressure and which has cooling/heating surfaces interposed therein, with the water-cooled rollers preventing a blockage in the convection heating surfaces or in the discharge device as a result of large pieces of slag.

The present invention is, of course, in no way restricted to the specific disclosure of the specification and drawing, but also encompasses any modifications with the scope of the appended claim.

What I claim is:

1. An apparatus for the dry removal of hot residues, resulting from a gasification of coal or carbon-containing solid material, in the lower region of a shaft-like fluid flow gasification reactor which is operated under pressure and in downward flow, includes a pressure tank wall the inside of which is lined with insulating material, and is provided with at least one cooling device; said apparatus, when viewed in the axial direction and from top to bottom, comprising seven successively arranged Zones A–G, and includes:

a wall-heating surface which extends from Zone A to Zone F, and is disposed parallel to and on the inner side of said insulation of said tank wall; said wall-heating surface has an axially-parallel tube-fin-tube construction with cooling medium circulating therethrough in counter-current and upwards flow; in Zone A, when viewed from the top toward the bottom, said wall-heating surface tapers in a funnel-like manner from a large cylindrical diameter to a small cylindrical diameter; in Zone C, said wall-heating surface has a constricted throat; in Zone D, said wall-heating surface passes over from a cylindrical cross section having the small diameter which exists prior to said constricted throat into the cross section of a four-cornered chamber, which latter cross sectional shape is maintained to Zone F;

inlet openings which are provided in and through said wall-heating surface in Zone C directly ahead of and at the narrowest part of said constricted throat for cold, clean product gas which is to be used as fluidizing and cooling gas;

a size-reducing and conveying device in the form of two cooled crushing rings which operate in opposite directions, said size-reducing and conveying device being disposed in Zone D directly after the narrowest part of said constricted throat;

convection heating surfaces located in Zone E and provided with tubes having small intervals therebetween, said convection heating surfaces being tied into said cooling medium circulation for said wall-heating surface; and a shutoff and charging system disposed in Zone G directly below an entry region for said cooled wall-heating surface.

* * * * *